United States Patent [19]

Kolb et al.

[11] 4,071,334

[45] Jan. 31, 1978

[54] METHOD AND APPARATUS FOR PRECIPITATING PARTICLES FROM A GASEOUS EFFLUENT

[75] Inventors: Alan C. Kolb, Solana Beach; James E. Drummond, Coronado, both of Calif.

[73] Assignee: Maxwell Laboratories, Inc., San Diego, Calif.

[21] Appl. No.: 602,730

[22] Filed: Aug. 7, 1975

Related U.S. Application Data

[63] Continuation-in-part of Ser. No. 502,103, Aug. 29, 1974, abandoned.

[51] Int. Cl.[2] ..... B03C 1/00

[52] U.S. Cl. ..... 55/2; 55/149; 55/150; 55/139; 250/427; 361/230

[58] Field of Search ..... 55/2, 11, 17, 101, 102, 55/108, 123, 135, 136, 137, 138, 139, 150, 154, 157, 149; 317/4, 3; 361/230; 250/423, 427

[56] References Cited

U.S. PATENT DOCUMENTS

| | | | |
|---|---|---|---|
| 1,787,955 | 1/1931 | Rosecrans | 55/123 |
| 1,976,214 | 10/1934 | Brion et al. | 55/123 |
| 2,836,750 | 5/1958 | Weimer | 55/2 |
| 3,495,379 | 2/1970 | Hall et al. | 55/2 |
| 3,653,185 | 4/1972 | Scott et al. | 55/103 |

FOREIGN PATENT DOCUMENTS

| | | | |
|---|---|---|---|
| 697,918 | 9/1953 | United Kingdom | 55/102 |

*Primary Examiner*—Bernard Nozick
*Attorney, Agent, or Firm*—Fitch, Even, Tabin & Luedeka

[57] ABSTRACT

Apparatus and a method for electrically sweeping particles from a gaseous effluent are disclosed which are particularly efficient in removing small as well as large particles. A voltage is applied across two electrodes in such a way that a strong electric field can be generated between them. A source of ions is provided by bombardment of the effluent gas stream with electrons. A strong electric field established between the electrodes creates at least one region of ions having only one polarity and moves these ions towards the oppositely charged electrode. In the region having ions of one sign, these ions rapidly charge the particles, especially small sized particles because of the strong electric field. The charged particles are moved by the field and deposited on the oppositely charged collection electrode where they agglomerate in preparation for collection and disposal.

28 Claims, 3 Drawing Figures

METHOD AND APPARATUS FOR PRECIPITATING PARTICLES FROM A GASEOUS EFFLUENT

This is a continuation-in-part of our original application, Ser. No. 502,103 filed Aug. 29, 1974 now abandoned.

The present invention generally relates to electrostatic precipitators, and more specifically, to a method and apparatus for electrostatically precipitating particles of different sizes from a gaseous medium, including those having a diameter less than 5 microns.

The increased emphasis being given to reducing levels of air pollution has culminated in a wealth of local, state, and federal legislation setting rigorous standards for particle removal from industrial and other gaseous emissions. Since the problems of air pollution directly affect a vast majority of the public, particularly in those urban areas where industry is concentrated, it is assumed that the standards may become even more rigorous in the future. While improvements continue in the design and effectiveness of particle removal apparatus, including electrostatic precipitators, the rigorous standards that are now being adopted have shown that many present types of precipitators are relatively ineffective in removing very small particles. This is coupled with the recent realization that the greatest number of particles in industrial gaseous effluents are in the range of about 0.1 to 10 microns in diameter, and also that the smallest particles remain suspended in the air for the longest time. Moreover, the greatest health hazard is posed by particles in the range of about 0.1 to 5 microns in diameter, according to the National Bureau of Standards Technical News Bulletin, dated December 1972.

All electrostatic precipitators use two charging mechanisms to build up the charge on a dust particle. These two mechanisms are diffusion charging and field charging. In field charging, ions are accelerated by the electric field of the precipitator. These accelerated ions strike a dust particle and combine with it. As the dust particle accumulates these charges, it takes on the same charge as the ions. When the dust particle becomes charged and has the same charge as the ion, the ion and charged particle tend to repel each other, which makes it more difficult for other ions to add additional charges to the particle. For a given electric field strength and a given size of dust particle, there will be a limit beyond which the dust particle will no longer accept additional charges by field charging. For small particles in conventional precipitators, this limit is very quickly reached. The other charging mechanism, diffusion charging, utilizes thermally activated ions that possess sufficient energy to penetrate the repelling field and add additional charges to the dust particle. This charging mechanism will charge small particles, but is quite slow compared to the mechanism of field charging.

It is generally known that presently used industrial precipitators are relatively ineffective in removing particles having a size range of about 0.1 to 3 microns. Conventional electrostatic precipitators fail to collect these fine particles as rapidly as the larger particles because the diffusion mechanism is the mechanism that is used to deposit electrical charge on the small particles and it operates too slowly for such particles. Ions drift onto the particles by thermal motion so that as a particle begins to acquire a charge, it repels the slower moving ions which could bring further charges to the particle.

Stated in other words, large particles are predominately charged by the charging mechanism of field charging which is subject to a limit based upon the electrostatic repulsion of the charged particle against further charges approaching it. Those charges are typically driven by an electric field applied by remote electrodes. Thus, in the prior art apparatus and in the present invention the balance between the driving and repelling forces determines the maximum charge which can be acquired, $N_s$:

$$N_s = \frac{52\,\epsilon\,ED^2}{\epsilon + 2}$$

where $N_s$ is the saturation number of electronic magnitude charges, E is the applied electric field in kilovolts per centimeter, D is the particle diameter in micrometers and $\epsilon$ is the particle dielectric constant. However, in conventional electrostatic precipitators, the mean charging and collection field is limited to about 4 kV/cm because it is linked to a higher field which supports a corona discharge adjacent a small, field enhancing electrode and higher fields tend to cause spark breakdown in the gas. Thus, for a 0.3 micron diameter particle, the maximum (for large $\epsilon$) saturation charge produced by the electric field in an ordinary electrostatic precipitator is about 20 electron charges.

In conventional electrostatic precipitators, the only effective charging method for charging small particles is by diffusion charging because of the low electric field. The number of charges added is given approximately by the following equation:

$$N = 0.03\,T\,D\,\ln\,(1 + 7.6 \times 10^{-4}\,N_o\,D\,t/T^{1/2})$$

where T is ion kinetic temperature in degrees Kelvin, $N_o$ is the ambient concentration of ions/cm$^3$ and $t$ is the time in seconds after the field charging has been completed. Since the charge attained after a long time by diffusion is proportional to $D\ \ln D$, it will exceed the field produced charge for small particles. In typical Cottrell precipitators, for example, ion densities are several times $10^7$/cm$^3$. At this ion density, about 0.3 second is required to deposit 20 charges on a 0.3 micron diameter particle while 24 seconds would be required to double this charge and the transit time of gas through typical precipitators is only about 8 seconds.

In other words, conventional electrostatic precipitators operate by producing ions of both polarities in a corona discharge plasma near one small electrode around which the electric field concentrates. The strength of the field is quite high near the electrode and drops dramatically away from the electrode and thereby provides a nonuniform field. Ions of one polarity (usually negative) are withdrawn from this region and as they drift toward the other electrode, they become attached to the aerosol particles in the effluent. To produce the field enhancement necessary for corona discharge at one electrode without causing electrical breakdown between the two electrodes, conventional precipitators often make use of coaxial geometry with a small diameter wire as the center electrode and a large diameter outer cylinder. The drift of the ions is caused by the interaction of the charge on the ion and the nonuniform, generally weak electric field. As the ions drift, they charge the particles by attaching to them, thereby causing the particles to be driven by the electric field toward and attached to the collecting electrode.

The efficiency of all electrostatic precipitators including those of the prior art and also of the present invention is limited by three major factors, especially for the aerosol particles which are less than five microns in diameter. The first arises because the charging rate of the aerosol particles decreases rapidly as the radius of the particles decreases. Thus, as the size of the particles decreases, the particle charge is less and the drift velocity, i.e., the component of the average velocity of the particles directed toward the electrodes, decreases. The second factor is that for a given charge the drift velocity decreases as the electric field strength decreases. Thus, the drift velocity of a given size particle decreases as it moves in the direction toward the collecting electrode because of the decreasing field in the coaxial electrode configuration. The third factor is the attachment efficiency of the collector electrode, i.e., the particles which are drifted to the collector electrode may rebound or be dislodged by the impact of other particles or be swept away by the turbulent flow of the gaseous effluent after they have been initially collected upon it because the charge on the particles and the electric field they experience are not sufficiently large.

It has generally been recognized that improved operation of an electrostatic precipitator results from increasing the electric field strength provided, however, that electrical breakdown or arcing does not result from the higher electric field strength. The prior art also discloses precipitating apparatus which independently produce the ions and the electric field rather than a configuration that uses a small wire central electrode and outer cylindrical electrode to simultaneously create the ions and the electric field. While radioactive materials and photoionization sources, e.g. light tubes such as ultraviolet lamps, have been disclosed to provide a source of ions independently of the production of the electric field, these ion sources have practical operational and other disadvantages and it is not believed that any commercial apparatus have been developed. A disadvantage of radioactive sources is the difficulty in varying the energy and quantity of particles emitted by such sources. Further, the psychological impact of using a radioactive source of ions in a precipitating apparatus, particularly in an urban area, could be quite negative. Moreover, there could be a significant problem of radioactive contamination of the atmosphere if a rupture or breakdown of some portion of the apparatus occurred. Precipitators that use ultraviolet or other lamps to provide photons for creating the necessary ionization within the precipitator are also subject to many practical operational disadvantages. The lamps are subject to dusting or clouding over by the particles in the gaseous medium or effluent and will become dirty quite rapidly. This dusting over may easily occur in only a few seconds and greatly decreases the efficiency of their operation. Moreover, the photon energy created by such lamps cannot be continuously and conveniently controlled.

However, the present invention does not suffer from the disadvantages of these radioactive and photoionization sources and, in fact, exhibits many desirable attributes that enables it to achieve the results sought by the above sources in addition to other significant advantages.

More particularly, the present invention utilizes an electron generating source (often also referred to as an electron beam generator, E-beam generator or the like) to bombard the gaseous medium within the precipitator with high energy electrons and produce a plasma region therein. The electron generating source has the advantages of being able to accurately control the penetration and density of the electrons that are injected into the gaseous medium and thereby control the extent of the plasma region. Further, the "window" or surface through which the electrons are injected into the medium, i.e. the surface through which the electrons pass which is in contact with the gaseous medium, is self cleaning and will not dust up or become dirty from the particles within the gaseous medium or effluent. These and other advantages will be described in detail hereinafter.

Accordingly, it is an object of the present invention to provide an improved method and apparatus for precipitating particles from a gaseous medium such as a gaseous effluent, which method and apparatus are effective to remove extremely small particles, i.e., those particles between about 0.1 and 5 microns in diameter and particularly those less than 1 micron in diameter.

Yet another object of the present invention is to provide an improved method and apparatus for removing particles from gaseous effluents with high volume throughput, high efficiency, and only moderate power requirements.

Other objects and advantages of the present invention will become apparent upon reading the following detailed description, in conjunction with the attached drawings, in which.

Broadly stated, the present invention is directed to apparatus as well as a method for precipitating or removing particles from a stream of gaseous effluent which preferably uses a generally uniform, strong electric field for charging the particles with ions, with the ions being supplied independently of the source of the electric field from a plasma that is formed by high energy electrons. A precipitating station includes at least one positively and one negatively charged electrode for setting up the electric field, and a source of ions which charge the particles. The particles charged in the presence of the electric field are thereby precipitated or removed from the gaseous effluent and collected at one of the electrodes. High-energy electrons are directed so as to produce a plasma in the gaseous medium or effluent near one of the electrodes and the particles have no net positive or negative charge within this neutral region of plasma. However, the charged electrodes and plasma produce a charged region between the plasma and the collecting electrode, so that once the particles are within the charged electrical region, they will acquire a net charge, and be attracted to the oppositely charged collection electrode.

Figure 1:
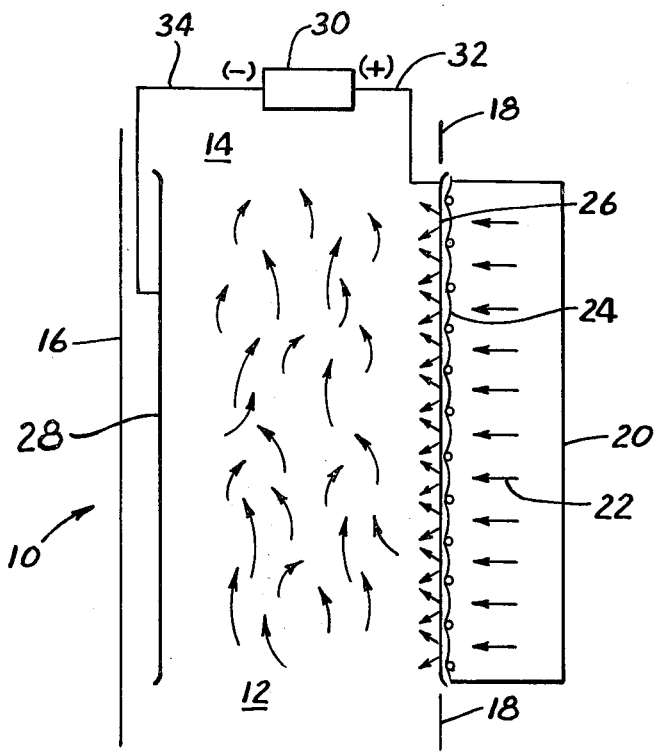
FIG. 1 is a diagrammatic representation of precipitating apparatus embodying the present invention and which is useful for practicing the method of the present invention.

Referring to the drawings and particularly FIG. 1, an idealized schematic cross-sectional diagram of apparatus which may be used to carry out the method of the present invention is shown. The apparatus, indicated generally at 10, communicates a gaseous medium or effluent from the lower inlet 12 through to the outlet 14 in an upward direction as shown. Side walls 16 and 18 direct the flow through the apparatus. An electron generating source 20 is positioned within an opening in the side wall 18 and produces high energy electrons indicated by the arrows 22 which penetrate a thin transmission window 24 as well as a positively charged electrode or anode 26 into the gaseous medium. A negatively charged electrode 28 is positioned adjacent the side wall 16 so that an electric field is set up between the anode and the cathode across substantially the entire channel width as shown. The anode 26 and cathode 28 are charged by a direct current source 30 having its positive terminal connected to the anode 26 through line 32 and its negative terminal connected to the cathode 28 through line 34. As is depicted by the curved arrows within the channel or area inside between the inlet and outlet of the apparatus, the effluent preferably has some turbulence so that large-scale mixing of the particles occurs as it passes through the apparatus. Because of the mixing action, virtually no particles will remain for any length of time in the region containing ions of both signs close to the positively charged electrode 26. The particles will be swept into the region between electrodes 26 and 28 during this passage. The electrodes 26 and 28 are preferably generally flat, planar members having arcuate edges that are charged by the external source 30 to positive and negative potentials, respectively. The inside surface of electrode 26 is shown to be generally coplanar with side wall 18 since the flat electrode fits an opening in the right side wall. The generally flat configurations and curved edges of the cathode and anode are preferred to minimize electric field maxima, i.e. it is desirable that the average field strength approach the maximum field strength within the apparatus. Stated in other words, it is desirable that the electric field be uniform so that it can be maximized without experiencing electrical breakdown or arcing. The electrode 26 separates the stream of gaseous medium on its left side as shown in the drawing from a quiescent gaseous medium on its right side that is preferably sealed from the left side to prevent dust to accumulate between the electrode 26 and the window 24. The thin wall or window 24 separates the quiescent medium from a region of very low pressure, i.e. as much as $3 \times 10^{-4}$ tor. The window 24 can be fabricated from any material that will transmit electrons therethrough that is also capable of separating the low pressure within the electron generator 20 from the exterior pressure. Thus, the window 24 can be made from titanium, aluminum, stainless steel, nylon and the like. The anode plate 26 may be made of a thin sheet of conductive material such as titanium, aluminum, or stainless steel with the combined thickness of the anode and window being preferably less than about 2 mils (0.002 inches) to permit penetration of the electrons through them. When the window 24 is made of conductive material, it can be designed to also serve as the anode 26. However, in general, it may be preferred to use a separate anode 26 to simplify the servicing of the electron beam generator. Further, in certain embodiments it may be preferred to form the electrode 26 from a screen material or from rods. Means for constricting or expanding the gas flow to adjust its velocity and to control the mixing action or to control turbulence of the flow are not shown. The anode 26 is preferably charged to produce as high a field strength as possible, generally of about 12 to 18 kilovolts per centimeter in the gaseous medium. However, any potential up to the breakdown potential of the gaseous medium may be used. The electron beam generator 20 is positioned between the inlet 12 and outlet 14 so as to irradiate the gaseous medium or effluent with electrons passing through window 24 and anode 26 and the generator preferably has power to provide an electron beam having an energy density sufficient to generate enough ions to charge all the particles in the gaseous medium to nearly saturation.

The electron generator is preferably positioned so that it irradiates only the volume immediately adjacent the anode surface. This is achieved by using electrons that can only penetrate a short distance into the gaseous medium. The electron generator 20 preferably operates at sufficient voltage to produce ionization and sufficient current to generate the quantity of ions that are capable of charging the particles in the gaseous stream. In this regard, the electron generator preferably operates to provide electrons entering the gaseous medium with an energy of between about 1 KeV and about 12 KeV per centimeter of plate separation and at a current level of about one microampere per meter of electrode width perpendicular to the gas flow. For a configuration having a .5 mil thick titanium window where the window also functions as the anode and with a 10 cm spacing between the anode and cathode, the apparatus performed satisfactorily with electrons of between 100 KeV and 115 KeV entering the window.

In accordance with an important aspect of the present invention, if the window 24 of the electron beam generator also acts as the electrode 26, the window 24 exposed to the particle laden gaseous medium is self cleaning. If a separate electrode 26 is used, the electron beam from the generator acts to prevent particle buildup on the anode 26. While there may be some particles on the exposed surface of either configuration at any one time, there is no buildup of particles on it due to its self cleaning operation. The exposed surface does not experience any accumulation of small particles because they are repelled before they can reach the surface. As the small particles are bombarded by the electrons produced by the electron generator, the electrons go completely through them causing secondary emission and the small particle becomes positively charged and is repelled by the positively charged surface. Thus, small particles never reach the surface and cannot accumulate on it.

With respect to larger particles, however, the electrons bombarding the particle will not travel through the particle and secondary emission effects will not be significant compared to the piling up of electrons within the particle. Thus, voltage on the inside of the particle builds up within the particle and it becomes quite negative. If the particle is in contact with the surface, it will discharge to the point of contact between the particle and the surface. This discharge produces a discharge path that can be analogized to the shape of a tree, i.e. the discharge path goes from the branches and combines in a larger trunk portion where it contacts the surface. The paths are holes in the particle caused by vaporizing the solid of the particle to a gas. The vaporization produces a thousand fold volume increase which escapes through the discharge paths. This vaporization process produces a great force that blows the particle from the surface or destroys the particle itself, either result being effective to rid the surface of the particle. Moreover, the force of one particle being removed will effectively remove several others as well.

This cleaning action can be increased by increasing the operating voltage of the electron generator. It should therefore be understood that the operating voltage can be varied, perhaps periodically, to control the cleaning action. An optimum duty cycle can be established that would effect adequate cleaning and minimize the power requirements for the overall operation of the apparatus.

The upper electric field strength limit is determined by the dielectric strength of the gaseous medium at operating pressure. For a ten centimeter separation distance between cathode and anode, a separation distance used in one embodiment of the apparatus, the uniform field breakdown strength of air at normal density is about 26 kV/cm. Since the absolute temperature in a typical gaseous effluent will be in the range of about 400° K to 600° K, the gas density will be about a factor of two lower than normal atmospheric density, and the limiting field strength would be about 13 kV/cm. However, electron-attaching gases, such as sulfur dioxide for example, will often be present in a gaseous effluent, and the presence of these gases may enable operation at a higher electric field value than the described 13 kV/cm.

It should also be understood that the electron generator may generate a single broad steady beam or one or more narrow beams and may also be adapted to scan the area within the apparatus in a predetermined pattern. For example, the pattern may have the beam follow a moving gaseous medium through a volume for an average dwell time for particles within that volume, then treat other volumes successively in like manner and then after an average diffusion time required to repopulate the first region with particles, return to that first volume.

The residual, ambient mixing action or turbulence of the flow of the gaseous medium through the apparatus carries the particle-laden gaseous medium to within a distance defining the laminar flow boundary sublayer of the charged electrodes. Within a region of thickness comparable with the range of the electrons in the medium, the charge on dust particles is nearly neutralized because of the presence of ions of both signs. In the rest of the volume, however, their charging rates are no longer neutralized and build rapidly so that by the time the eddy motion carries the gaseous flow to and then away from the cathode 28, dust particles which have positive charge remain because of the electrical force that is exerted upon the charges. The particles may acquire additional charges by impingement of gaseous ions while they are attached to the cathode. This would increase the holding force so that they would not be inclined to be dislodged. However, if the dust is of very high resistivity, excessive local field strength can result from this charge buildup and cause harmful local breakdown. This local breakdown can be prevented by keeping the ion density in the gaseous medium low except in the region of initial particle charging. Particles of all sizes rapidly collect on the cathode 28 because the electric field, no longer limited to about 4 kV/cm in the bulk of the gas by the requirement of corona generation at one edge, can be raised to between 13 and about 18 kV/cm. In the preferred form of operation, the high field covers virtually all the distance between the electrodes. It should be understood that while the above description deals with pulling positive ions from the region of neutral plasma, the present invention is applicable to ions of negative polarity. However, the use of positive ions has the advantage in that electrons and negative ions are pulled back toward the anode and the thickness of the region of neutral plasma is minimized, as is desired. As previously mentioned, the saturation charge by the usual mechanism of field charging is subject to a limit caused by the electrostatic repulsion between the particles that have acquired a charge and additional charges which approach it.

In accordance with the present invention, however, the saturation charge on all particles is much greater because the mean electric field strength can be raised by about a factor of between about 3 and 5. Thus, a maximum of between about 60 and 80 charges would be deposited on a 0.3 micron particle in an 18 kV/cm field, while only about 20 to 30 charges are typically deposited during the transit of such a particle through an ordinary electrostatic precipitator. With respect to field charging, the initial charging rate is given by $$dN/dt = \frac{4.7 \times 10^{-5} E N_o \epsilon D^2}{\epsilon + 2}$$

where D is the particle diameter in microns, E is the electric field strength in kilovolts per centimeter, $\epsilon$ is the dielectric constant of the particle, and $N_o$ is the ambient ion concentration in number per cubic centimeter. Values for $N_o$ are about $3 \times 10^7$ per cubic centimeter in conventional precipitators. In the present invention, $N_o$ is controlled independently of the field strength E, whereas these two values are interlinked in conventional precipitators. The field strength can be controlled independently of $N_o$ to achieve particular advantages, i.e., the field strength can be reduced to minimize power consumption or increased to maximize the charging rate. For example, in an 18 kV/cm field, with an $N_o$ of $3 \times 10^7/cm^3$, dN/dt equals between about 800 and 2200 per second for a 0.3 micron particle so that the particle very rapidly approaches its saturation charge of about 60 to 80. If for other reasons, it is necessary to reduce the field, the charging rate can be maintained by increasing $N_o$.

From the above, it should be understood that a large decrease in charging time as well as a large increase in total charge occurs for a 0.3 micron diameter particle being charged in the large electric fields that can exist in a channel where ions are supplied by the agency of high-energy electrons from an electron generator, for example, rather than in the smaller overall fields typical of a conventional precipitator. Thus, electron beam supported charging may exceed charging currently used in prior art precipitators in both the rate and maximum charge attainable in reasonable dwell times of particles in the precipitator, and also may require less power during operation. Furthermore, the electric field acting on each of these charges is larger by a factor of about 4 and will provide an average precipitation velocity that will be about 12 times larger than that which would be experienced by 0.3 micron particles in present conventional precipitators. However, since only one of the two surfaces collects these particles, the effective collection rate per unit area will only be increased by a factor of about 6. An alternative design using two electron guns on opposite sides of a central collecting cathode would increase the collection rate by a factor of about twelve. Alternatively, an electron beam may be projected down the center of the precipitator to produce a plasma. Each electrode would then attract its respective oppositely charged particles and would be precipitated out of the gaseous medium.

Referring to FIG. 1, it should be understood that the thin curved electron beam window 24 is preferably covered with the thin metal anode 26 to protect the stressed window 24 from corrosive gases and large particles in the gaseous medium or effluent. The thin flat protective cover anode 26 also produces a smoother electric field distribution and thereby allows a higher average field strength.

Figure 2:
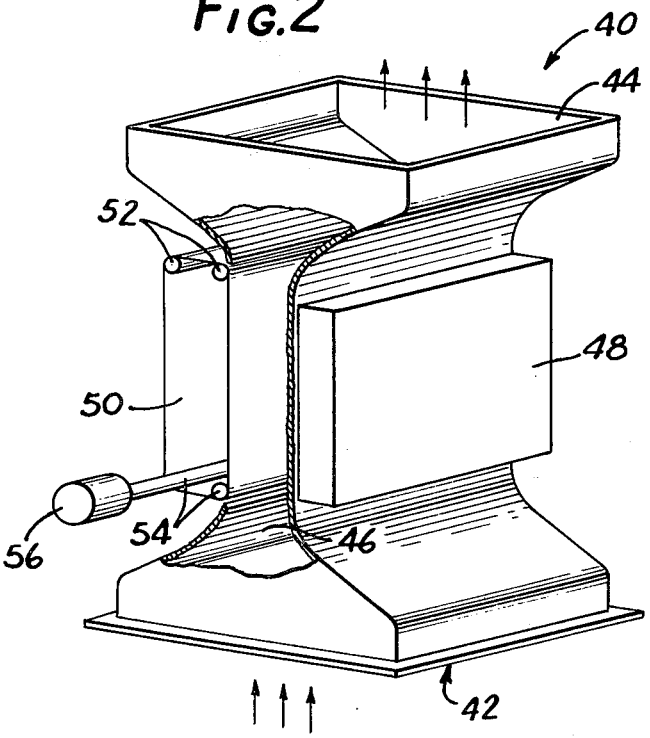
FIG. 2 is a perspective view of one form of the apparatus that may be used to practice the method of the present invention; and, FIG. 3 is a schematic illustration of another embodiment of the present invention.

Turning now to FIG. 2 which illustrates one form of apparatus that is useful in practicing the method of the present invention, the apparatus 40 has an inlet 42 at its lower end and an outlet 44 at its upper end, with gaseous medium or effluent flowing vertically upwardly as shown by the arrows. The dust laden gaseous effluent preferably flows in the precipitation channel at 5 to 10 meters per second. An electron generator 48 is positioned to irradiate the effluent while it is within the channel 46. A cathode is provided and may be in the form of a flexible stainless steel belt 50 as shown which travels around upper and lower rollers 52 and 54, respectively, with one of the lower rollers being driven by a motor 56. The belt has a front side exposed to the gaseous medium or effluent containing high resistivity dust passing through the channel and a back side that is outside of the channel, enabling the particles to be removed from the belt before the belt reenters the channel and again becomes exposed to the effluent. One advantage of the apparatus shown in FIG. 2 is that it is of a relatively small height compared with less effective prior art precipitators for a given throughput rate.

Figure 3:
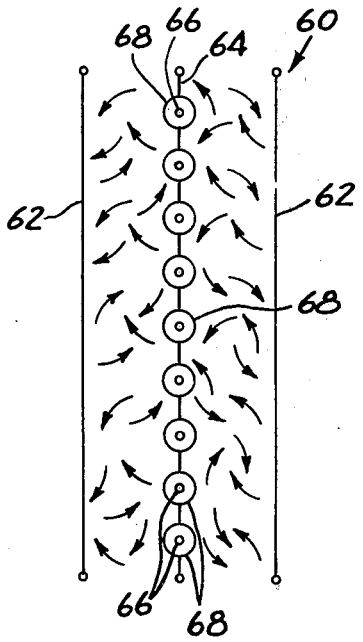

In accordance with another aspect of the present invention and referring to the cross-sectional view shown in FIG. 3, apparatus, indicated generally at 60, and also embodying the present invention, communicates a gaseous medium or effluent in a direction toward the reader. As is depicted by the curved arrows within the apparatus, the effluent is preferably given some turbulence so that large scale mixing of the particles occurs as it passes through the apparatus. Because of the mixing action, the particles will be swept around and brought in close proximity to negatively charged cathodes 62 as well as the positively charged anode 64 during this passage. The turbulent action removes particles from the region of neutral charge density near the electron beam window, bringing them through the region of positive charge density to within close range of the cathodes. This allows all particles to be attracted to the cathodes so that they may be subject to precipitation out of the gaseous medium before it is discharged at the outlet. It should be understood that while the diagrammatic representation shown in FIG. 3 does not illustrate either the side or end exterior walls of the apparatus, the electrodes 62 and 64 will be positioned within the outer side walls which guide the flow of effluent through the apparatus. The electron generators preferably comprise a number of thin wires or roughened rods 66 enclosed within evacuated tubes 68 in the anode surface 64. These wires are small and charged to a sufficiently large negative potential that they emit electrons by field emission. Alternatively, the wires 66 may be heated and emit electrons thermionically. These electrons are attracted to the thin anode wall tubes 68 and, because of the high voltage difference, have sufficient energy to penetrate the thin metal anode 64. Anode supports (not shown) consist of structural reinforcing loops of metal that are spaced periodically within the tubes 68. The operation is substantially similar to that described with respect to the apparatus of FIG. 1. An advantage of the configuration of FIG. 3 is that if the vacuum seal near one of the wires 66 is broken, voltage can be removed from the broken wire 66 without substantially adversely affecting the operation of the apparatus.

From the foregoing detailed description, it should be understood that a method and apparatus for electrostatically precipitating particles from a particle carrying gaseous medium has been illustrated and described which is more efficient than conventional designs and is effective in removing extremely small particles, even to such small sizes as 0.1 micron in diameter. In addition to effectively precipitating such small particles, the present invention provides rapid charging and rapid precipitation of such small as well as larger particles, and enables fast throughput of the gaseous medium or effluent.

Although particular embodiments of the present invention have been illustrated and described, various modifications, substitutions and alternatives will be apparent to those skilled in the art, and accordingly, the scope of the invention should be only defined by the appended claims and equivalents thereof.

Various features of the invention are set forth in the following claims.

What is claimed is:

1. A method of electrostatically precipitating particles from a gaseous medium carrying the same, comprising:

passing the medium through a channel in a precipitating station wherein said particles are brought into a first region containing ions of only one sign;

subjecting the medium to a supply of electrons from an electron beam generator to generate a supply of ions of both signs in a second region, said ions of one sign in said first region being supplied from said second region;

subjecting said medium to a generally uniform, strong electric field to drive said ions of one sign onto said particles, the average field strength of said electric field approaching the maximum field strength therein;

said electric field causing attraction of said charged particles to one or more electrodes having a charge of opposite polarity relative to the charged particles to thereby precipitate said particles out of the medium.

2. A method as defined in claim 1 wherein said second region is adjacent one or more electrodes.

3. A method as defined in claim 1 wherein said station includes at least one negatively charged electrode, said charged electrodes attracting oppositely charged particles.

4. A method as defined in claim 1 wherein an electron source produces said supply of electrons.

5. A method as defined in claim 4 wherein said electron source has sufficient voltage to produce ionization and sufficient current to generate a quantity of ions capable of charging said particles.

6. A method as defined in claim 4 wherein said electrons have an energy of between about 1 KeV and about 12 KeV per centimeter of electrode separation and about 1 microampere per meter of electrode width perpendicular to the gas flow.

7. A method as defined in claim 1 wherein the volume of said second region is small relative to the volume of said first region.

8. A method as defined in claim 8 wherein the volume of said second region is less than about 10% of the volume of said first region.

9. A method for electrostatically precipitating particles from a gaseous medium carrying the same, comprising the steps of:

passing the medium through an electrostatic precipitating station in a manner whereby the medium passes near at least one positively and at least one negatively charged electrode located at said station, said electrodes being charged to produce a strong electric field within said precipitating station;

subjecting said medium adjacent the positively charged electrode to high energy electrons from an electron beam generating means;

said electrons being effective to produce a plasma of predetermined thickness in a region adjacent said positive electrode, the positive ions traveling outside of said region bombarding the particles of the medium, thereby resulting in said particles acquiring a net positive charge so that the magnitude of the attractive force between the particles and said negative electrode increases sufficiently so that the particles move towards said negatively charged electrode.

10. A method as defined in claim 9 wherein said electrons are produced by an electron generator that has sufficient voltage to produce ionization and sufficient current to generate a sufficient quantity of ions to charge said particles passing through said station.

11. A method as defined in claim 10 wherein said electrons have an energy of between about 1 KeV and about 12 KeV per centimeter of electrode separation and about one microamperes per meter of electrode width perpendicular to the gas flow.

12. A method for removing particles from a gaseous medium at a precipitating station having a plurality of electrodes including at least one anode and at least one cathode, the cathode being adapted to attract particles having a net positive charge, comprising the steps of:

charging said electrodes to produce a strong, uniform electrical field within said precipitating station;

passing the particle containing medium through at least one channel in the precipitating station with sufficient mixing action to sweep the said particles out of any region having a plasma with a predominately neutral net charge therein;

subjecting the medium to high energy electrons generated by an electron beam generator as said particles enter said precipitating station, said generator being effective to produce a plasma region having positive and negative ions, said plasma region being small relative to the volume of said channel, the positive ions passing out of said plasma region bombarding particles of said medium and causing them to acquire a net positive charge, the mixing action and the high electric field therein effecting said positively charged particles to be attracted to said cathode.

13. A method as defined in claim 12 wherein said plasma region is located adjacent said anode.

14. A method as defined in claim 12 wherein said plasma region occupies less than about 10% of the volume of said channel.

15. A method as defined in claim 12 wherein said electrodes are in the form of generally flat members having curved edge portions.

16. A method as defined in claim 12 wherein said electron generator has sufficient voltage to produce ionization in said plasma region and sufficient current to generate a sufficient quantity of ions to charge said particles passing through said station.

17. A method as defined in claim 16 wherein said electrons have an energy of between about 1 KeV and about 12 KeV per centimeter of electrode separation and about one microampere per meter of electrode width perpendicular to the gas flow.

18. A method as defined in claim 12 wherein said electrodes create a high electric field wherein the average field strength approximates the maximum field strength.

19. A method as defined in claim 18 wherein said average field strength is up to the range of about 12 kV/cm to about 18 kV/cm.

20. A method for removing particles from a gaseous medium at a precipitating station having a plurality of electrodes including one or more positively charged anodes and one or more negatively charged cathodes, the anodes being adapted to attract particles having a net negative charge, comprising the steps of:

charging said electrodes to provide a uniform, strong electrical field within said precipitating station;

passing the medium through at least one channel in the precipitating station with sufficient mixing action to sweep the said particles out of any region of plasma with a predominately neutral net charge therein;

subjecting the medium containing the particles to electrons generated by an electron beam generator as said particles enter said precipitating station, said generator being effective to produce a plasma region having positive and negative ions, said plasma region being small relative to the volume of said channel, the negative ions passing out of said plasma region bombarding particles of said medium and causing them to acquire a net negative charge, the mixing action and electrical influence therein effecting attraction between said negatively charged particles and said anode.

21. A method as defined in claim 20 wherein said electrodes are in the form of generally flat members having curved edge portions.

22. A method as defined in claim 20 wherein said plasma region occupies less than about 10% of the volume of said channel.

23. A method as defined in claim 20 wherein said electron generator has sufficient voltage to produce ionization in said plasma region and sufficient current to generate a sufficient quantity of ions to charge said particles passing through said station.

24. A method as defined in claim 23 wherein said electrons have an energy of between about 1 KeV and about 12 KeV per centimeter of electrode separation and about one microampere per meter of electrode width perpendicular to the gas flow.

25.

Apparatus for removing particles from a gaseous medium passing therethrough, comprising:

an inlet for receiving and an outlet for expelling the medium;

a central portion located between and being in communication with said inlet and outlet, said central portion guiding said medium through the apparatus;

one or more positively charged electrodes being located in said central portion;

one or more negatively charged electrodes located in said central portion for attracting particles having a net positive charge from the medium;

means for charging said electrodes in said central portion to provide a uniform, high electric field in said central portion of said apparatus;

an electron beam energy source means for injecting high energy electrons into said central portion for producing a supply of positive ions which bombard particles and cause them to be attracted to the negatively charged electrode.

26. Apparatus as defined in claim 25 wherein said electrons have an energy of between about 1 KeV and about 12 KeV per centimeter of electrode separation and about one microampere per meter of electrode width perpendicular to the gas flow.

27. Apparatus as defined in claim 25 wherein said electron energy source means produces said supply of ions adjacent said positively charged electrodes.

28. Apparatus as defined in claim 25 wherein said electrodes are generally planar and parallel to one another and have arcuate edges to provide a generally uniform strong electric field therebetween.

* * * * *

UNITED STATES PATENT AND TRADEMARK OFFICE

CERTIFICATE OF CORRECTION

PATENT NO. : 4,071,334

DATED : January 31, 1978

INVENTOR(S) : Alan C. Kolb and James E. Drummond

It is certified that error appears in the above-identified patent and that said Letters Patent are hereby corrected as shown below:

Column 10, line 66, after "claim" change "8" to --7--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*